US007625057B2

(12) United States Patent
Koase

(10) Patent No.: US 7,625,057 B2
(45) Date of Patent: *Dec. 1, 2009

(54) METHOD FOR ADJUSTING EJECTION TIMING AND EJECTION TIMING ADJUSTING APPARATUS

(75) Inventor: Takashi Koase, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 71 days.

This patent is subject to a terminal disclaimer.

(21) Appl. No.: 11/959,336

(22) Filed: Dec. 18, 2007

(65) Prior Publication Data

US 2008/0143769 A1 Jun. 19, 2008

(30) Foreign Application Priority Data

Dec. 19, 2006 (JP) ..... 2006-341514

(51) Int. Cl.
*B41J 29/38* (2006.01)

(52) U.S. Cl. ..... 347/14; 347/15

(58) Field of Classification Search ..... 347/14–15, 347/17, 19, 57

See application file for complete search history.

(56) References Cited

U.S. PATENT DOCUMENTS 6,241,334 B1 * 6/2001 Haselby ..... 347/19
7,258,429 B2 * 8/2007 Takahashi et al. ..... 347/78

FOREIGN PATENT DOCUMENTS

JP 10-329381 12/1998

* cited by examiner

*Primary Examiner*—Trinh H Nguyen
(74) *Attorney, Agent, or Firm*—Hogan & Hartson LLP

(57) ABSTRACT

The invention relates to a method for adjusting ejection timing including: forming adjustment patterns on a medium by shifting relative ejection timings of liquid droplets from a first nozzle row and a second nozzle row lined up in a direction intersecting a row direction in which nozzles of the first nozzle row and the second nozzle row are lined up, while shifting the first nozzle and the second nozzle in respect to the medium in the intersecting direction of the first nozzle row and the second nozzle row; and determining adjustment amounts of relative ejection timings of the first nozzle row and the second nozzle row based on the adjustment patterns, wherein the adjustment patterns are formed in the intersecting direction in a plural number separated from each other by a predetermined distance, and the ejection timing is adjusted based on an average of the adjustment amounts determined based on the adjustment patterns.

7 Claims, 14 Drawing Sheets

METHOD FOR ADJUSTING EJECTION TIMING AND EJECTION TIMING ADJUSTING APPARATUS

CROSS-REFERENCE TO RELATED APPLICATIONS

The present application claims priority upon Japanese Patent Application No. 2006-341514 filed on Dec. 19, 2006, which is herein incorporated by reference.

BACKGROUND

1. Technical Field

The present invention relates to methods for adjusting ejection timing and ejection timing adjusting apparatuses.

2. Related Art

There are printers having two heads disposed lined up in a direction intersecting a row direction in which nozzles of nozzle rows are lined up. These two heads are disposed such that the position of one of the heads is shifted in the nozzle row direction by a distance corresponding to half a nozzle pitch. Through this, it is possible to double the resolution in the nozzle row direction. In order to perform printing using heads disposed in this manner, it is required to adjust in advance the landing positions of liquid droplets ejected from those two heads with respect to a movement direction of the head.

A method has been used in order to adjust the landing position in the movement direction; an adjustment pattern, in which the ejection timings of liquid droplets ejected from a first head and a second head are shifted by small degrees, is printed, and then the optimal ejection timing of the liquid droplets is selected so as to carry out necessary adjustment (JP-A-10-329381).

However, when a drive pulley for moving the head is decentered or the like, the movement amount of varies when the head is moved. Then, such variance in the movement amount due to such decentering causes a movement error.

Forming an adjustment pattern and adjusting the ejection timing of liquid droplets based thereon results in adjustment of the ejection timing of liquid droplets based on the adjustment pattern formed while affected by a movement error. The movement error is composed of a consistent error component and an error component that periodically varies, the components being combined. It is difficult to determine the amount of the error component that periodically varies while the pattern is recorded. Therefore, it is impossible to properly adjust the ejection timing due to the indeterminable varying component contained in the movement error.

SUMMARY

The invention has been achieved to address the above-described circumstances, and has an advantage of enabling proper adjustment of the ejection timing of liquid droplets ejected from a plurality of heads.

A primary aspect of the invention in order to achieve the above-described advantage is a method for adjusting ejection timing including:

forming adjustment patterns on a medium by shifting relative ejection timings of liquid droplets from a first nozzle row and a second nozzle row lined up in a direction intersecting a row direction in which nozzles of the first nozzle row and the second nozzle row are lined up, while shifting the first nozzle and the second nozzle in respect to the medium in the intersecting direction of the first nozzle row and the second nozzle row; and determining adjustment amounts of relative ejection timings of the first nozzle row and the second nozzle row based on the adjustment patterns, wherein the adjustment patterns are formed in the intersecting direction in a plural number separated from each other by a predetermined distance, and the ejection timing is adjusted based on an average of the adjustment amounts determined based on the adjustment patterns.

Features and advantages of the invention other than the above will become clear by reading the description of the present specification with reference to the accompanying drawings.

BRIEF DESCRIPTION OF THE DRAWINGS

For a more complete understanding of the invention and the advantages thereof, reference is now made to the following description taken in conjunction with the accompanying drawings wherein.

DESCRIPTION OF EXEMPLARY EMBODIMENTS

Figure 1:
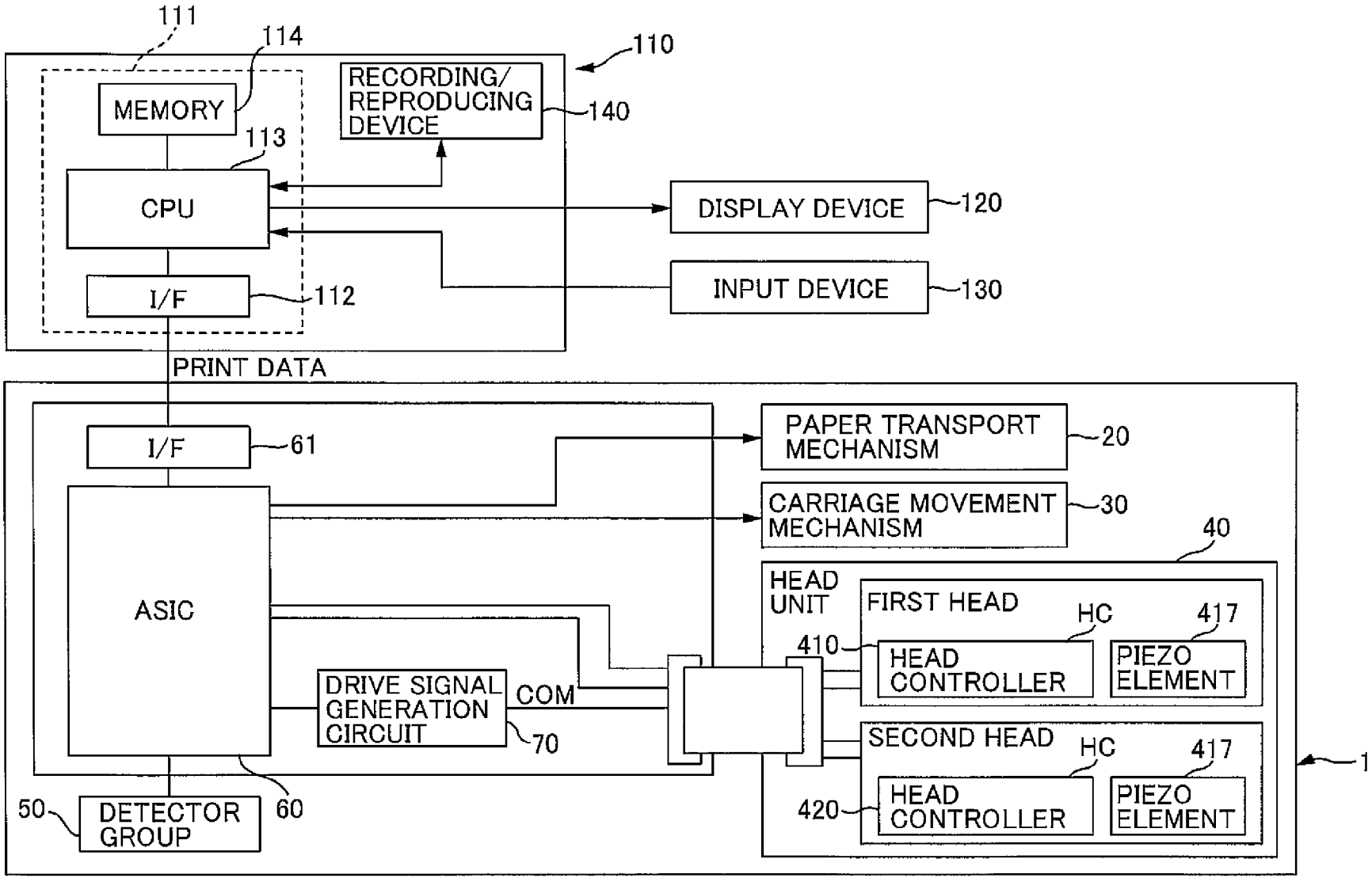
FIG. 1 is a block diagram of the overall configuration of a printing system according to a first embodiment.

At least the following matters will be made clear by reading the description of the present specification with reference to the accompanying drawings.

A method for adjusting ejection timing including:

forming adjustment patterns on a medium by shifting relative ejection timings of liquid droplets from a first nozzle row and a second nozzle row lined up in a direction intersecting a row direction in which nozzles of the first nozzle row and the second nozzle row are lined up, while shifting the first nozzle and the second nozzle in respect to the medium in the intersecting direction of the first nozzle row and the second nozzle row; and determining adjustment amounts of relative ejection timings of the first nozzle row and the second nozzle row based on the adjustment patterns, wherein the adjustment patterns are formed in the intersecting direction in a plural number separated from each other by a predetermined distance, and the ejection timing is adjusted based on an average of the adjustment amounts determined based on the adjustment patterns.

Through this, the ejection timing of liquid droplets ejected from a plurality of heads can be properly adjusted.

In such a method for adjusting ejection timing, it is preferable that the predetermined distance corresponds to a circumferential length obtained when a rotating member for shifting the first nozzle row and the second nozzle row has performed a half rotation. Also, it is preferable that the adjustment patterns are formed in an even number, and the ejection timing is adjusted based on the average of the adjustment amounts formed based on the adjustment patterns in an even number.

Also, it is preferable that with respect to the direction of the first nozzle row, each nozzle of the first nozzle row is positioned between two nozzles of the second nozzle row. It is preferable that the adjustment patterns are formed in a manner in which the landing position of liquid droplets from the second nozzle row is shifted in the intersecting direction with respect to the landing position of liquid droplets from the first nozzle row, as a result of the ejection timing of liquid droplets from the second nozzle row being shifted for each nozzle. Further, it is preferable that the adjustment patterns are formed in a manner in which ink droplets ejected from a predetermined number of nozzles of the first nozzle row and ink droplets ejected from a predetermined number of nozzles of the second nozzle row alternately land with respect to the first nozzle row direction.

Through this, the ejection timing of liquid droplets ejected from a plurality of heads can be properly adjusted.

An ejection timing adjusting apparatus, including:

a recording device that forms adjustment patterns on a medium by shifting relative ejection timings of liquid droplets from a first nozzle row and a second nozzle row lined up in an intersecting direction in which nozzles of the first nozzle row and the second nozzle row are lined up, while shifting the first nozzle row and the second nozzle row in respect to the medium in the intersecting direction of the first nozzle row and the second nozzle row; and an input device that inputs adjustment amounts of relative ejection timings of the first nozzle row and the second nozzle row based on the adjustment patterns, wherein the adjustment patterns are formed in the intersecting direction in a plural number separated from each other by a predetermined distance, and the apparatus further includes an arithmetic processing section that obtains the ejection timing based on an average of the adjustment amounts inputted based on the adjustment patterns.

Through this, the ejection timing of liquid droplets ejected from a plurality of heads can be properly adjusted.

A computer program for causing an ejection timing adjusting apparatus to operate, the program causing the ejection timing adjusting apparatus to carry out:

forming adjustment patterns on a medium by shifting relative ejection timings of liquid droplets from a first nozzle row and a second nozzle row lined up in a direction intersecting the row direction in which nozzles of the first nozzle row and the second nozzle row are lined up, while shifting the first nozzle and the second nozzle in respect to the medium in the intersecting direction, and determining adjustment amounts of relative ejection timings of the first nozzle row and the second nozzle row based on the adjustment patterns, wherein the adjustment patterns are formed in a plural number in the intersecting direction separated from each other by a predetermined distance, and the ejection timing is adjusted based on the average of the adjustment amounts determined based on the adjustment patterns.

Through this, the ejection timing of liquid droplets ejected from a plurality of heads can be properly adjusted.

Overall Configuration

FIG. 1 is a block diagram of the overall configuration of a printing system. A printing system 100 is provided with a printer 1, a computer 110, a display device 120, and an input device 130. The printer 1 is an inkjet printer that prints images on a medium such as paper, cloth, or film.

The computer 110 is provided with a CPU 113, a memory 114, an interface 112, and a recording/reproducing device 140. The CPU 113 executes various programs such as a printer driver, and for example carries out image processing on images to be printed by the printer 1, which is discussed later. The memory 114 stores programs such as a printer driver and data. The interface 112 is an interface such as USB or a parallel interface for connecting to the printer 1. The recording/reproducing device 140 is a device such as a CD-ROM drive or a hard disk drive for storing programs and data.

The computer 110 is communicably connected to the printer 1 via the interface 112, and outputs print data corresponding to an image that is to be printed, to the printer 1 in order to cause the printer 1 to print that image.

A printer driver is installed on the computer 110. The printer driver is a program for causing the display device 120 to display a user interface and for converting image data outputted from an application program to print data.

Regarding Configuration of the Printer

Figure 2A:
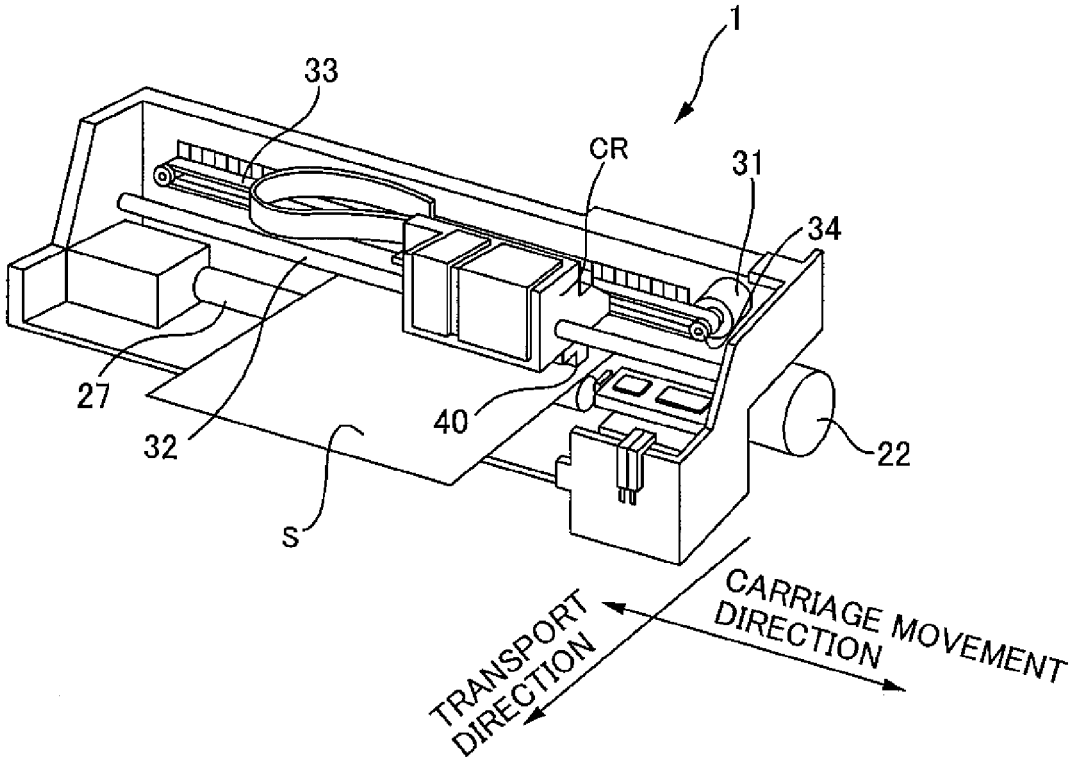
FIG. 2A is a perspective view of a printer 1.
Figure 2B:
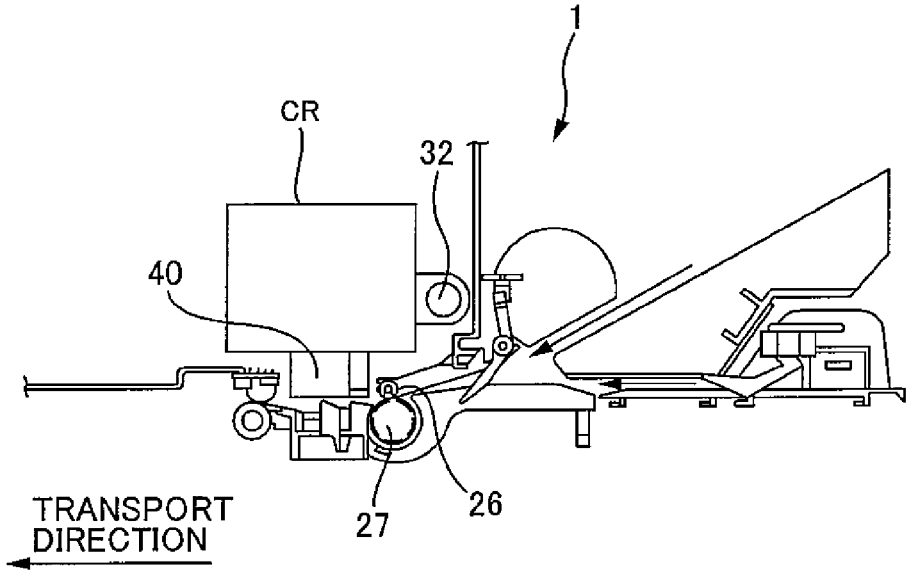
FIG. 2B is a cross-sectional view of the printer 1.

FIG. 2A is a perspective view of the printer 1. Furthermore, FIG. 2B is a cross-sectional view of the printer 1. The basic configuration of an inkjet printer is described below with reference to FIG. 1 as well.

The printer 1 has a paper transport mechanism 20, a carriage movement mechanism 30, a head unit 40, a detector group 50, an ASIC 60, and a drive signal generation circuit 70. The printer 1 receives print data from the computer 110. Then, based on the received data, the printer 1 controls various sections of the printer 1 (the paper transport mechanism 20, the carriage movement mechanism 30, the head unit 40, and the drive signal generation circuit 70) to print an image on the paper S.

The status of the printer 1 is monitored by the detector group 50. The detector group 50 outputs detection results to the ASIC 60. Then, based on these detection results, the ASIC 60 controls the various sections.

The paper transport mechanism 20 is for feeding the paper S as a medium to a printable position, and transporting this paper S with a predetermined transport amount in the transport direction. As showing in FIGS. 2A and 2B, the paper transport mechanism 20 has a transport motor 22 and a transport roller 27. The transport motor 22 is for transporting the paper S in the transport direction, and its operation is controlled by the ASIC 60. The transport roller 27 is for transports the paper S to a printable area by sandwiching the paper S in between itself and the driven roller 26. The paper transport mechanism 20 intermittently transports the paper S.

The carriage movement mechanism 30 is for moving the carriage CR attached with the head unit 40 in the movement direction of the carriage CR. The carriage movement mechanism 30 has a carriage motor 31, a guide shaft 32, a timing belt 33, and a drive pulley 34. Then, when the carriage motor 31 is controlled by the ASIC 60, the movement of the carriage CR in the movement direction is controlled. When the carriage motor 31 operates, the carriage CR moves along the guide shaft 32. Along with this, the head unit 40 also moves in the movement direction of the carriage.

The head unit 40 is for ejecting ink droplets on the paper S. The head unit 40 has a first head 410 and a second head 420. The first head 410 and the second head 420 are for forming dots by ejecting ink droplets on the paper S.

The first head 410 and the second head 420 respectively have four nozzle rows, and each nozzle row has a plurality of nozzles (here, 180 nozzles). The first head 410 and the second head 420 are provided to the carriage CR, therefore when the carriage CR moves, the first head 410 and the second head 420 also move in the same direction. Then, when the first head 410 and the second head 420 intermittently eject ink while moving, dot rows along the movement direction are formed on the paper S.

The detector 50 includes a linear encoder, and the position of the carriage CR can be grasped by the ASIC 60. Then, the predetermined amount of movement of the carriage CR can be controlled by the ASIC 60.

Regarding Configuration of Head Unit

Referring to FIG. 1 again, the head unit 40 is configured to include a carriage CR. The head unit includes the first head 410 and the second head 420. Each head includes four nozzle rows. Then, each nozzle row of each head includes 180 nozzles, and piezo elements 417 for ejecting ink droplets from the nozzles. An independent piezo element 417 is provided to each nozzle.

Further, each head of the head unit 40 includes a head controller HC. Furthermore, the driving pulse applied to the piezo element 417 of each nozzle is selected under the control of the head controller HC. Ink droplets are ejected from the individual nozzles due to the application of the driving pulses to the piezo elements 417. The head controller HC is controlled by the ASIC 60. Through this, the ejection timing can be shifted for each nozzle by the ASIC 60.

Figure 3:
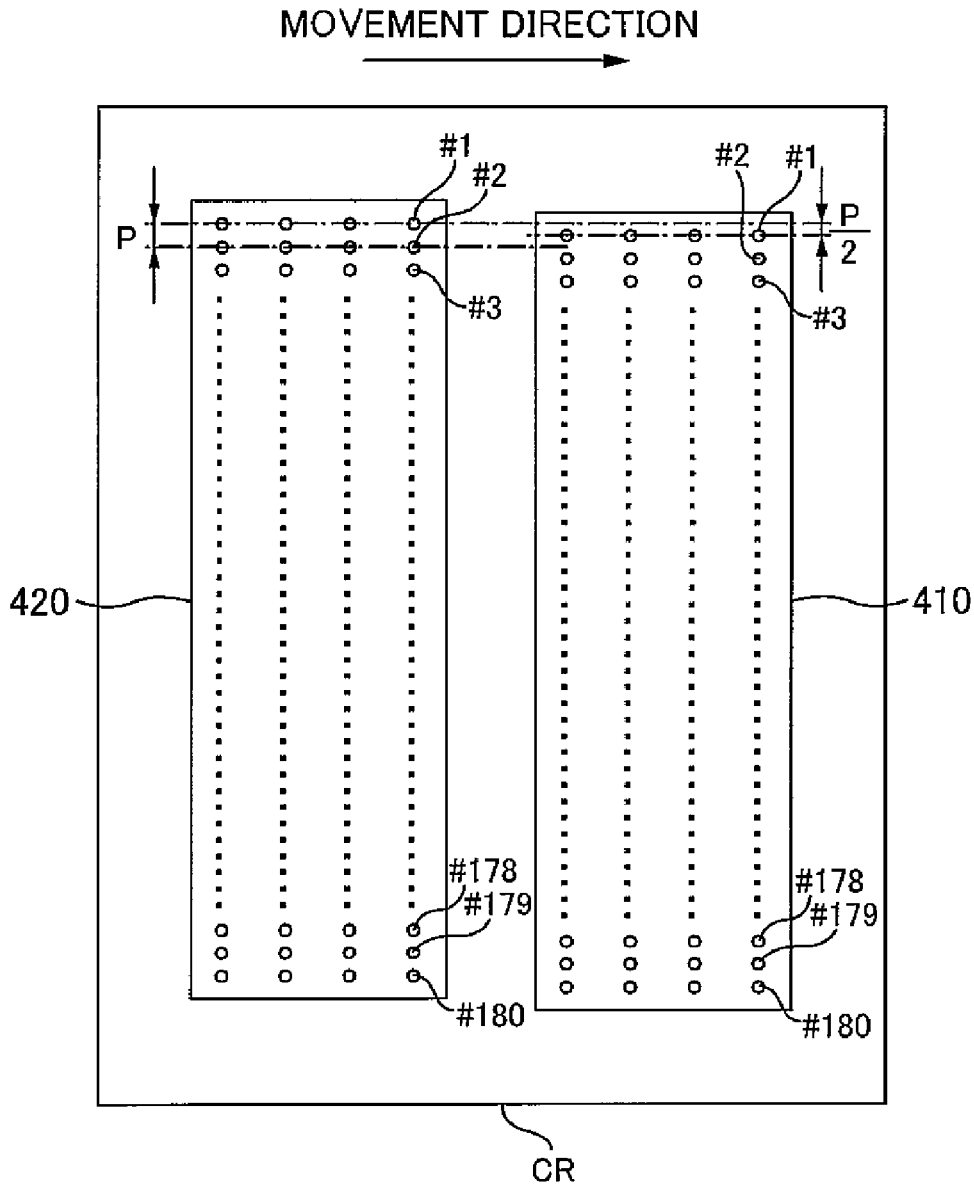
FIG. 3 is a diagram describing a first head and a second head included in a carriage CR.

FIG. 3 is a diagram describing the first head and the second head included in the carriage CR. Here, the first head 410 and the second head 420 are shown as viewed from above the printer 1. When viewed from above the printer 1, these nozzles are hidden by other components and cannot be seen. However, here the positions of the nozzles are drawn with solid lines to facilitate understanding of a relation among the nozzles of the first head 410 and the second head 420.

These heads are disposed such that the nozzle row direction corresponds to the paper transport direction. The first head 410 and the second head 420 respectively include four nozzle rows so as to eject four colors of ink droplets. The nozzles included in each nozzle row are 180 nozzles, namely #1-#180. The distance between nozzles in the nozzle rows (nozzle pitch P) is 1/180 inch.

The second head 420 is disposed shifted to the upstream side by half the nozzle pitch (P/2) in the paper transport direction with respect to the second head 410. Therefore, the nozzle #1 of the first head 410 is disposed between the nozzle #1 and the nozzle #2 of the second head 420. Specifically, the nozzle of the first head 410 is disposed so as to be positioned between two nozzles of the second head 420. In this manner, a resolution of 360 dpi is realized in the paper transport direction with the first head 410 and the second head 420.

The first head 410 and the second head 420 are disposed so as to overlap each other with respect to the movement direction of the carriage CR. As described above, the nozzle pitch of each head is 180 dpi. Nozzles of these two heads are disposed such that the nozzles of one head are positioned between the nozzles of the other head. In order to realize a resolution of 360 dpi with these heads, it is required to adjust the ejection timing of ink droplets such that the landing position of ink droplets ejected by the first head 410 and that of ink droplets ejected by the second head 420 match with respect to the movement direction of the carriage CR. An adjustment pattern described below, for example, can be used for adjusting the ejection timing.

Adjustment Pattern of Reference Example

Figure 4:
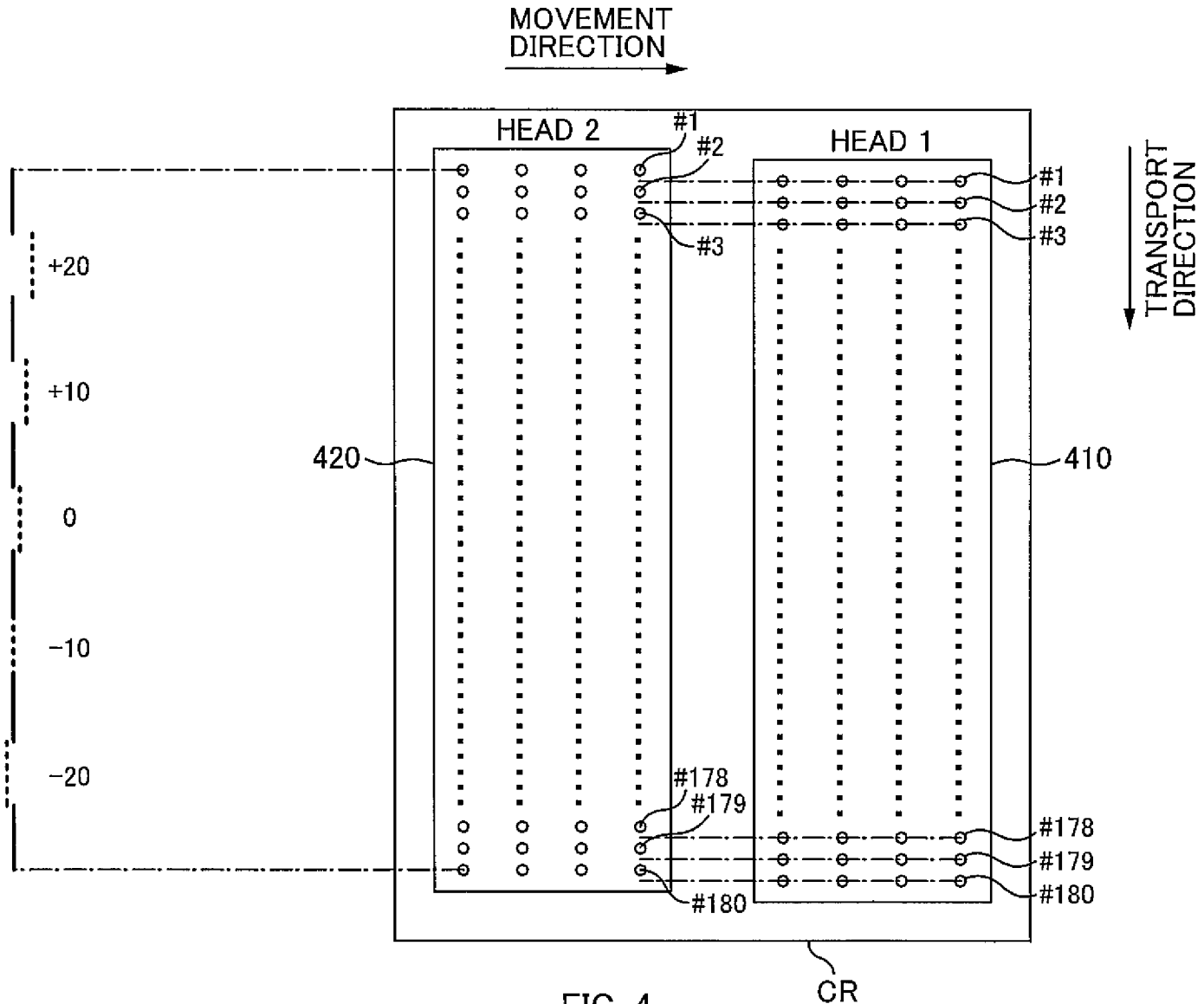
FIG. 4 is a diagram describing an adjustment pattern formed by ink droplets ejected from two heads.

FIG. 4 is a diagram describing an adjustment pattern formed with ink droplets ejected from two heads. Only the first head 410 and the second head 420 included in the carriage CR are shown in FIG. 4.

Each head includes a black ink nozzle row K, a cyan ink nozzle row C, a magenta ink nozzle row M and a yellow ink nozzle row Y. Here, the description is given assuming that only the black ink nozzle row K is used. It should be noted that the black ink nozzle row K of the first head 410 corresponds to the first nozzle row, and the black ink nozzle row K of the second head 420 corresponds to the second nozzle row.

The adjustment pattern is shown on the left side in the figure. Here, there is described the adjustment pattern for when the carriage CR moves from the left side to the right side in the movement direction in the figure. The adjustment pattern is formed as a result of ink droplets being ejected from the respective nozzles of the first head 410 and the second head 420. In the adjustment pattern shown in FIG. 4, the solid line represents the adjustment pattern formed with the first head 410 (first line) and the dashed line represents the adjustment pattern formed with the second head 420 (second line). Although the second line is depicted with the dashed line so as to be distinguished from the first line, actually, it is a solid line. In this manner, the adjustment pattern is formed such that the first line and the second line are arranged in alternation in the paper transport direction (nozzle row direction).

The ejection timing of the first lines is adjusted such that the first lines are on a straight line in the paper transport direction. On the other hand, the second lines are formed so as to be gradually shifted in the movement direction of the carriage CR. For this purpose, the ejection timing from the nozzles of the second head 420 is shifted by small degrees. A figure is indicated next to each second line. Each figure is the adjustment amount indicating for the second line next thereto, i.e., the amount (μm) by which the printer intended to shift the second line to the right side (right side in the drawing) in the movement direction of the carriage CR with respect to the first line when forming the second line. For example, "+20" means the ejection timing was controlled such that the printer 1 forms the second line shifted by 20 μm to the right side in the movement direction with respect to the first line. This adjustment amount can also be understood as indicating the shifted ejection timing. These adjustment amounts are not recorded on the paper in actuality, but they are shown in FIG. 4 for the convenience of description.

If the product is manufactured as designed, the second line formed with an adjustment amount of "0" is supposed to match the first line with respect to the movement direction of the carriage CR. However, due to various errors in various sections of the printer 1, the second line formed with an adjustment amount of "0" sometimes does not match the first line with respect to the movement direction. Therefore, the ink droplet ejection timing is adjusted with reference to the adjustment amount of the adjustment pattern, so that the landing position of the ink droplets ejected from the first head matches that of the ink droplets ejected from the second head with respect to the movement direction.

For example, in the case of FIG. 4, the first line matches the second line with respect to the movement direction when the adjustment amount is "−10". Accordingly, by readjusting the ejection timing of the ink droplets ejected from the second head 420 to an earlier timing such that the ink droplets land at the position shifted by 10 μm to the left side in the movement direction, the landing position of the ink droplets ejected from the first head 410 can be matched to that of the ink droplets ejected from the second head 420 with respect to the movement direction.

Movement Error Caused by Decentering

Figure 5:
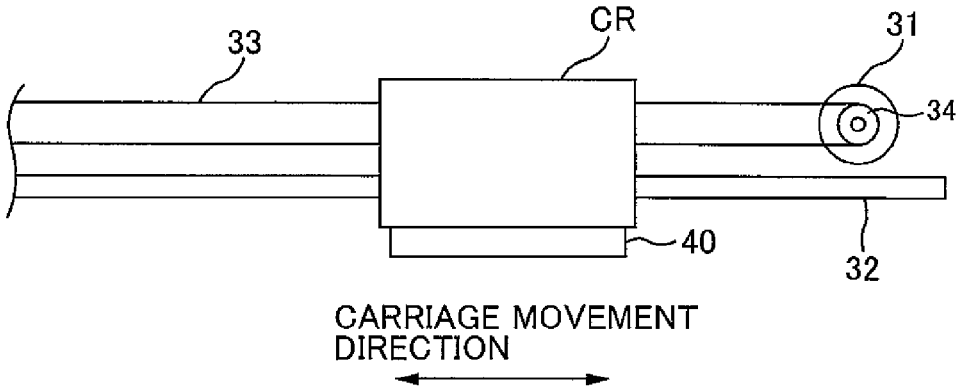
FIG. 5 is a diagram describing decentering of a drive pulley 34 of the printer 1.

FIG. 5 is a diagram describing decentering of the drive pulley 34 of the printer 1. As described above, the drive pulley 34 is rotated as a result of a carriage motor 31 rotating. Then, the timing belt 33 is moved as a result of the drive pulley 34 rotating. This drive pulley 34 corresponds to a rotating member that shifts the first nozzle row and the second nozzle row.

The drive pulley 34 may be decentered due to variance in quality. When the drive pulley 34 is decentered, the distance to the rotational center varies depending on the location on the circumferential surface of the drive pulley 34. Even if the rotation amount of the drive pulley 34 is the same, the movement amount varies depending on the location on the circumferential surface of the drive pulley 34.

The first head 410 and the second head 420 are held by the carriage CR at a certain distance in the movement direction (referred to as a "head-to-head distance"). Therefore, in order for ink droplets to land on the same position with respect to the movement direction of the carriage, movement by the head-to-head distance is required to be carried out after ejection of ink droplets from the first head 410 before ejection of the ink droplets from the second head 420. However, if the drive pulley 34 is decentered as described above, the movement amount ends in varying. In that case, movement carried out after forming the first line before starting forming the second line is also affected by the variance in the movement amount, which causes a movement error. Then, even if the liquid droplet ejection timing is adjusted based on the adjustment pattern, which is formed while affected by the movement error, correct adjustment of the ejection timing is impossible.

Figure 6A:
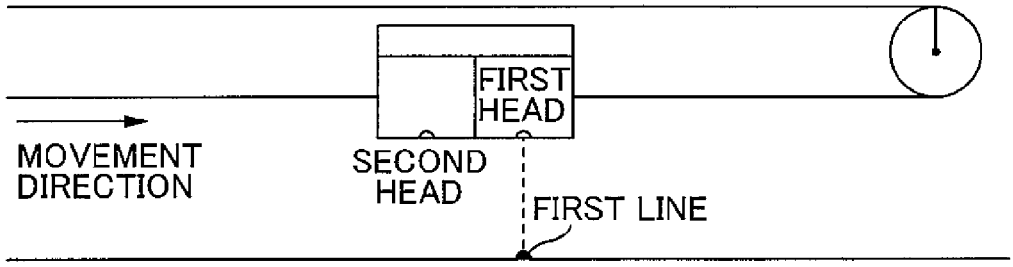
FIG. 6A is a diagram describing the state in which a first head forms a first line and then a second head forms a second line, when the drive pulley 34 is not decentered.
Figure 6B:
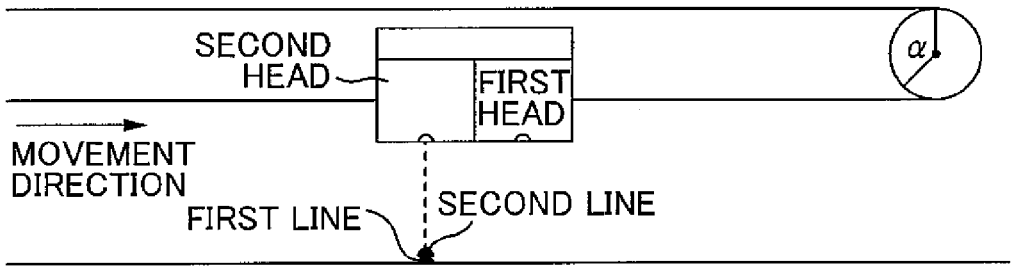
FIG. 6B is a diagram describing the state in which a first head forms a first line and then a second head forms a second line, when the drive pulley 34 is not decentered.

FIGS. 6A and 6B are diagrams describing a state in which the first head forms the first line and thereafter the second head forms the second line, when the drive pulley 34 is not decentered. In order to simplify the description, the first line and the second line formed with an adjustment amount of "0" are taken as an example.

In FIG. 6A, ink droplets are ejected from the first head to form the first line. Then, the carriage CR is moved. In FIG. 6B, when the drive pulley 34 has rotated a predetermined angle α so as to match the first line and the second line with respect to the movement direction, ink droplets are ejected from the second head to form the second line. In this case, the drive pulley 34 is not decentered, and the ejection timing of ink droplets is properly adjusted. Therefore, the first line and the second line formed with an adjustment amount of "0" match with respect to the movement direction.

Figure 6C:
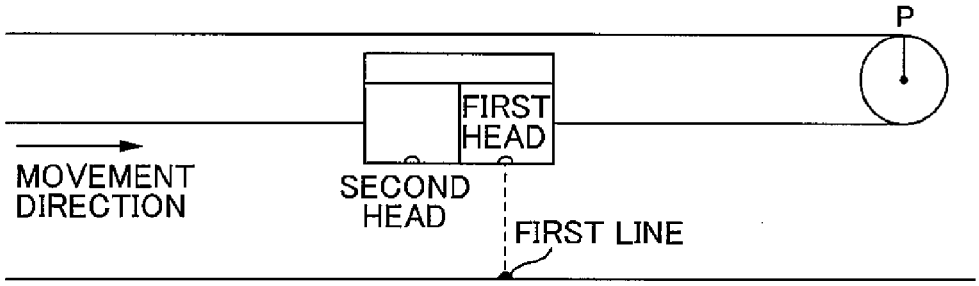
FIG. 6C is a diagram describing the state in which a first head forms a first line and then a second head forms a second line, when the drive pulley 34 is decentered.
Figure 6D:
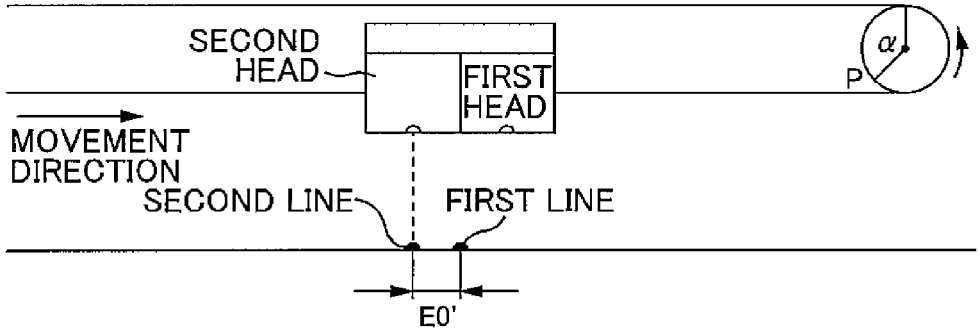
FIG. 6D is a diagram describing the state in which a first head forms a first line and then a second head forms a second line, when the drive pulley 34 is decentered.

FIGS. 6C and 6D are diagrams describing a state in which the first head forms the first line and thereafter the second head forms the second line, when the drive pulley 34 is decentered. In this case, the drive pulley 34 is assumed to be decentered.

In FIG. 6C, ink droplets are ejected from the first head to form the first line. Then, the carriage CR is moved. At this time, the drive pulley 34 is rotated by an angle α. Then, in FIG. 6D, the second line (formed with an adjustment amount of "0") is formed by the second head. However, a movement error E0' is produced due to decentering of the drive pulley 34, and thus the first line and the second line are formed shifted from each other with respect to the movement direction.

Referring again to FIGS. 6C and 6D, a reference point P is shown on the circumference of the drive pulley 34. The position on the circumference of the reference point P when the first head ejects ink droplets to form the first line is given as a rotational position X (rad) (X is a variable number). The position "0", which is the start point of the rotational position X, is set at the top of the circumference. The value of the variable number X increases as the drive pulley 34 rotates leftward. A movement error E' produced during movement carried out after forming the first line when the reference point P is at a rotational position X and before subsequently forming the second line is defined as the movement error E' at the rotational position X.

For example, in order to simplify the description, it is assumed that the first line is formed when the rotational position X is "0" (FIG. 6C). Thereafter, a predetermined movement is carried out and the second line is formed (FIG. 6D). Then, the movement error E0' as shown in FIG. 6D is assumed to have been produced. At this time, the movement error at the rotational position X of the reference point P=0 is E0'.

Figure 6E:
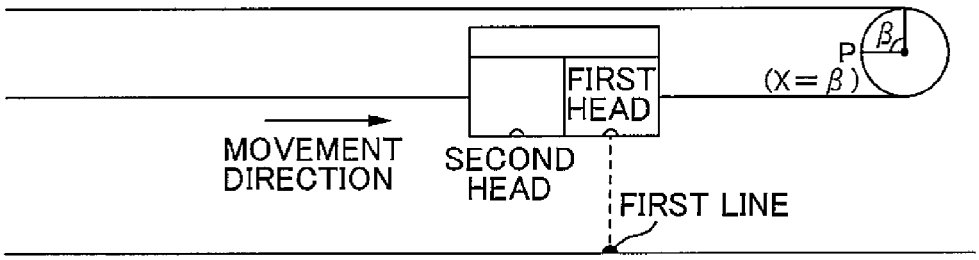
FIG. 6E is a diagram (of second example) describing the state in which a first head forms a first line and then a second head forms a second line, when the drive pulley 34 is decentered.
Figure 6F:
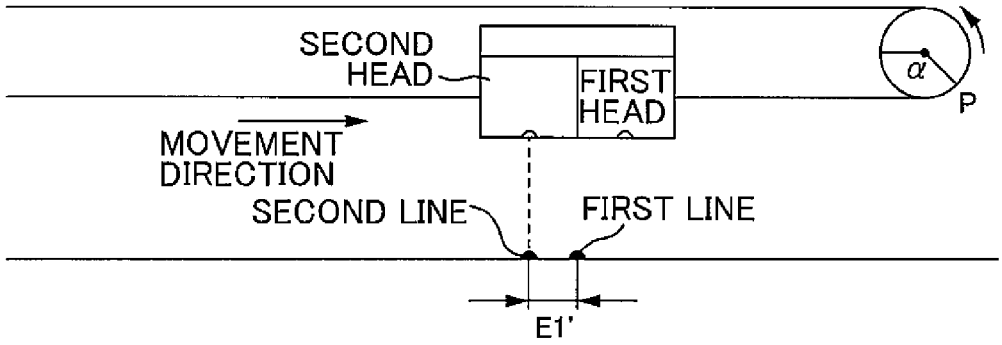
FIG. 6F is a diagram (of second example) describing the state in which a first head forms a first line and then a second head forms a second line, when the drive pulley 34 is decentered.

FIGS. 6E and 6F are diagrams (of second example) describing a state in which the first head forms the first line and thereafter the second head forms the second line when the drive pulley 34 is decentered. In FIG. 6E, the first line is assumed to have been formed when the rotational position X is at a certain rotational position P. Then, a predetermined movement is carried out and the second line is formed (FIG. 6F). Then, a movement error E1' as shown in FIG. 6E is assumed to have been produced.

At this time, the movement error at the rotational position X of the reference point P=β is E1'. The movement error E' produced due to decentering can be expressed as a function of the rotational position X.

Figure 6G:
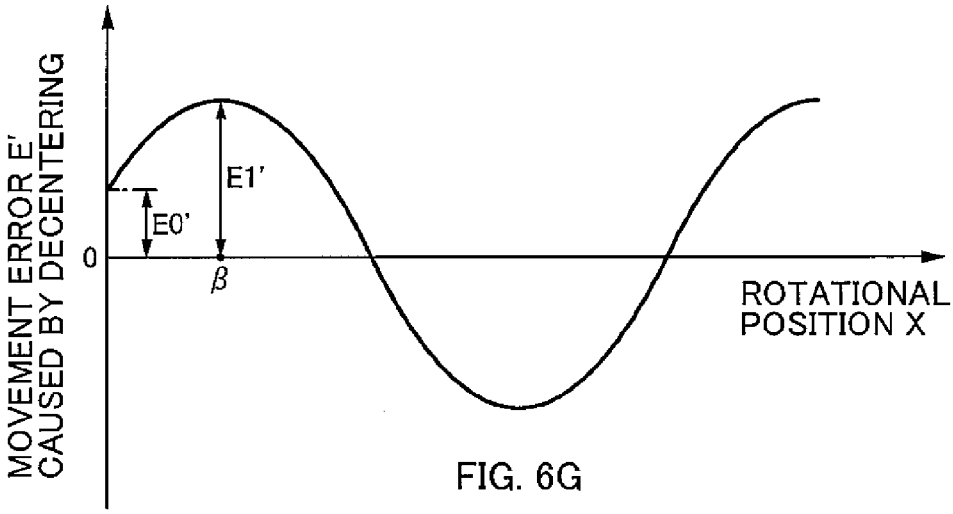
FIG. 6G is a graph showing the relation between a movement error produced due to decentering and a rotational position X.

FIG. 6G is a graph showing the relation between the movement error produced due to decentering and the rotational position X. The horizontal axis plots the rotational position X of the reference point P, while the vertical axis plots the movement error E1 that is produced due to decentering of the drive pulley 34. As the rotational position X of the reference point P shifts (depending on the formation position on the medium of the first line), the movement error E' varies. Then, this movement error E' indicates values that form a sine curve as shown in FIG. 6G.

Regarding Actual Movement Error

Figure 7:
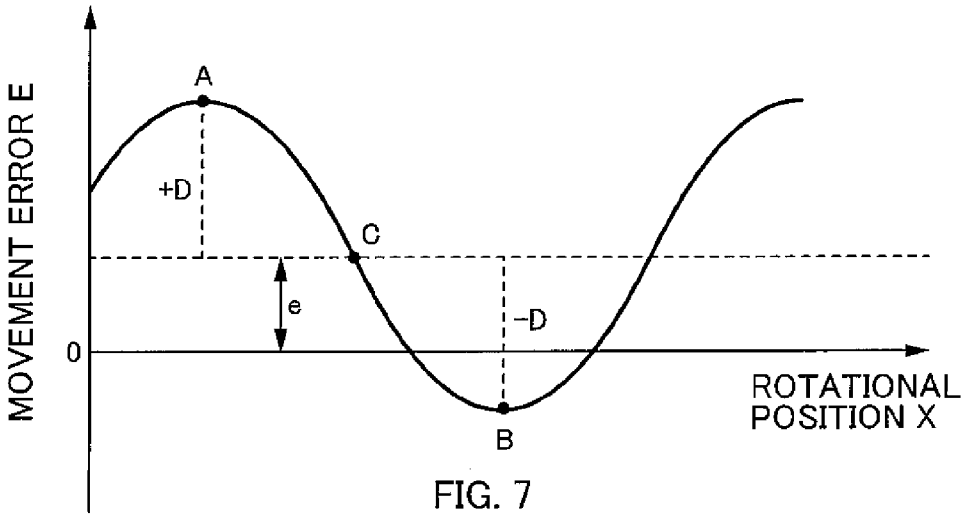
FIG. 7 is a graph describing the relation between the rotational position X of a reference point P and a movement error E.

FIG. 7 is a graph describing the relation between the rotational position X of the reference point P and the movement error E. The horizontal axis plots the rotational position X of the reference point P, while the vertical axis plots the movement error E. The actual movement error E is composed of a consistent component and a component that periodically varies, the components being combined. The periodic component appears with a full rotation of the drive pulley 34 constituting one period. This periodic component corresponds to the movement error E' produced due to the above-described decentering of the drive pulley 34, which is referred to as an AC component of the movement error. On the other hand, the consistent component is produced due to errors in various sections of the printer 1 as described above, or due to incorrect ejection timing of ink droplets from the second head, even when the drive pulley 34 is not decentered.

The AC component of the movement error E is caused by decentering of the drive pulley 34 as described above, and forms a sine curve with a maximum amplitude of "D". The AC component of the movement error at the oscillation center thereof is "e". If the drive pulley 34 is not decentered, and the movement error does not contain the AC component, the amount of the movement error to be produced will be "e". By adjusting the ejection timing of ink droplets from the second head such that the movement error "e" becomes "0" when the drive pulley 34 is not decentered, it is possible to constantly match the first line and the second line formed with an adjustment amount of "0".

Even when the drive pulley 34 is decentered and the movement error contains the AC component, it is preferable that the ejection timing of ink droplets from the second head is adjusted such that the movement error value "e" at the oscillation center (constant component value) becomes "0". The reason for this is described below.

Figure 8A:
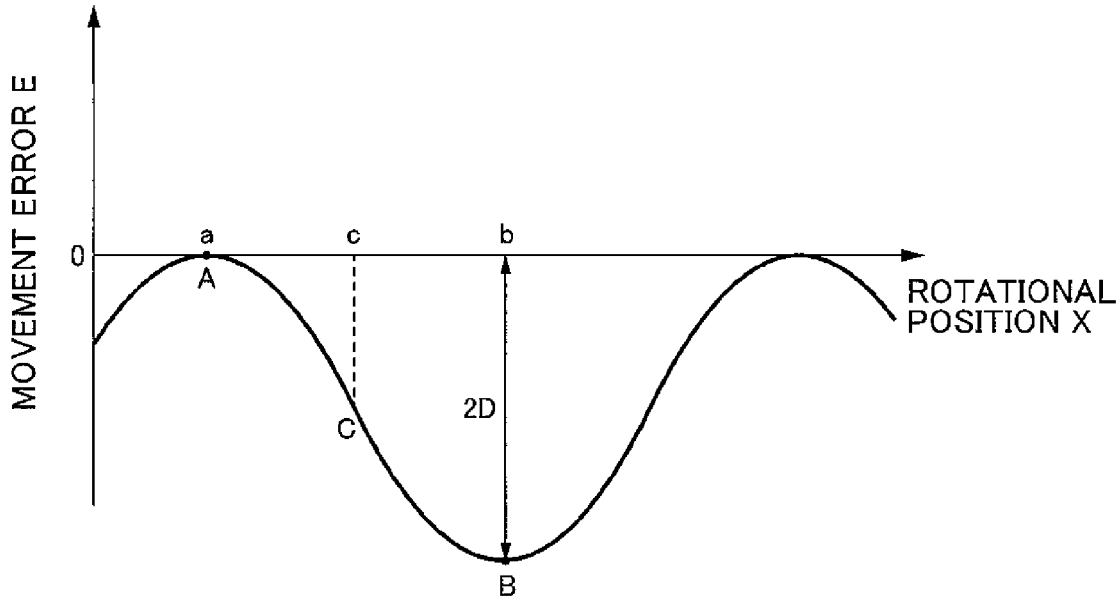
FIG. 8A is a graph showing the movement error when the ejection timing of an ink droplet is adjusted such that the movement error at the point A in FIG. 7 becomes 0.

FIG. 8A is a graph showing the movement error when the ejection timing of ink droplets was adjusted such that the movement error at the point A in FIG. 7 becomes "0". In FIG. 8A, the movement errors at the rotational position X=a, b and c are shown. Referring to FIG. 8A, while the movement error is "0" at the rotational poison X=a, as the rotational position X is increased from X=a to X=b, the movement error is gradually produced. In particular, the movement error E at the rotational position X=b amounts to "2D".

Figure 8B:
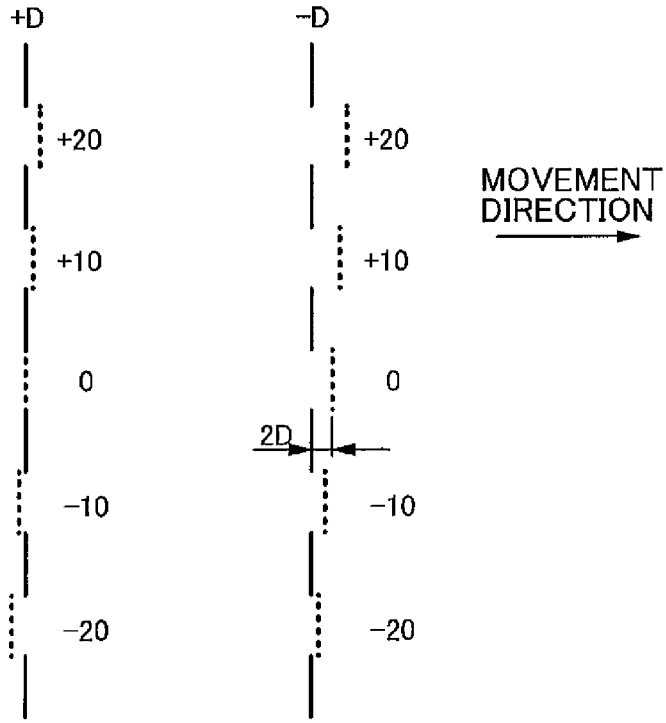
FIG. 8B shows an adjustment pattern when the ejection timing of an ink droplet is adjusted such that the movement error at the point A in FIG. 7 becomes 0.

FIG. 8B shows an adjustment pattern when the ejection timing of the ink droplets is adjusted such that the movement error at the point A in FIG. 7 becomes "0". Two adjustment patterns shown in FIG. 8B are adjustment patterns formed after the ejection timing has been adjusted based on the adjustment pattern obtained at the rotational position X=a. That is, in these two adjustment patterns, adjustment is performed such that the first line and the second line formed with an adjustment amount of "0" match at the rotational position X=a.

The adjustment pattern on the left side of FIG. 8B is formed at the rotational position X=a. The adjustment pattern on the right side is formed at the rotational position X=b. Here, as a matter of course, the movement error in the adjustment pattern on the left side is "0" (the first line and the second line formed with an adjustment amount of "0" match). However, in the adjustment pattern on the right side a movement error is produced. The amount thereof is "2D".

Figure 9A:
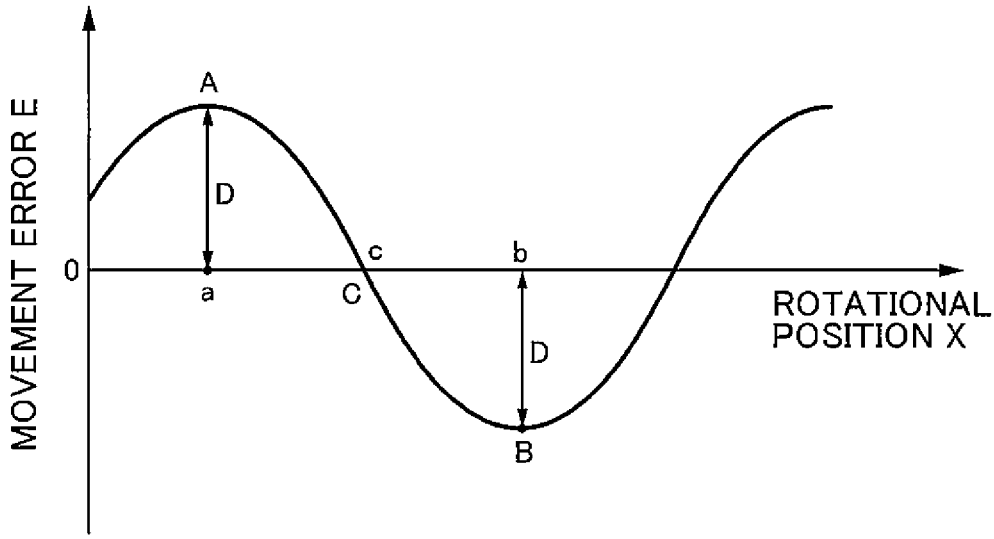
FIG. 9A is a graph showing the movement error when the ejection timing is adjusted such that the movement error at the point C in FIG. 7 becomes 0.

FIG. 9A is a graph showing the movement error when the ejection timing is adjusted such that the movement error at the point C in FIG. 8 becomes "0". In FIG. 9A, the movement errors at the rotational position X=a, b and c are shown. Referring to FIG. 9A, the movement error is "0" at the rotational poison X=c, and the movement error is "D" at the points A and B, where the maximum amplitude is produced.

Figure 9B:
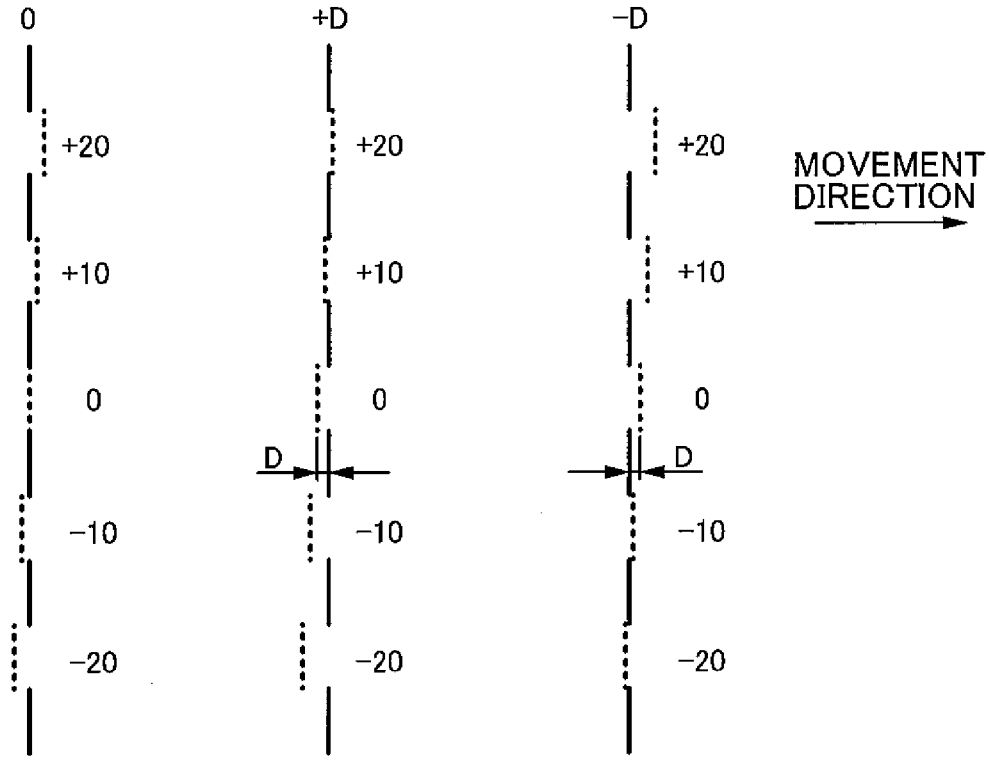
FIG. 9B shows an adjustment pattern when the ejection timing is adjusted such that the movement error at the point C in FIG. 7 becomes 0.

FIG. 9B shows an adjustment pattern when the ejection timing is adjusted such that the movement error at the point C in FIG. 7 becomes "0". Three adjustment patterns shown in FIG. 9B are adjustment patterns formed after the adjustment of the ejection timing has been adjusted based on the adjustment pattern obtained at the rotational position X=c. That is, in these three adjustment patterns, adjustment is performed such that the first line and the second line formed with an adjustment amount of "0" match at the rotational position X=c.

The adjustment pattern on the left side of FIG. 9B is formed at the rotational position X=c. The adjustment pattern at the center of FIG. 9B is formed at the rotational position X=a. The adjustment pattern on the right side of FIG. 9B is formed at the rotational position X=b. Here, as a matter of course, the movement error in the adjustment pattern on the left side is "0" (the first line and the second line formed with an adjustment amount of "0" match). However, in the other two adjustment patterns a movement error is produced. The amount thereof is "D" each.

When the ejection timing of ink droplets is adjusted such that the movement error at the point A or B becomes "0", the maximum shift amount between the first line and the second line becomes "2D". On the other hand, when the ejection timing of the ink droplets is adjusted such that the movement error at the point C becomes "0", the maximum shift amount between the first line and the second line becomes "D". Therefore, it is preferable that the ejection timing of the ink droplets is adjusted such that the movement error at the point C becomes "0" (the movement error at the oscillation center is "0") because of the smaller maximum shift amount.

If the point where the AC component of the movement error is "0" (the point C) can be determined during formation of the adjustment pattern, it is possible to adjust the ejection timing by forming the adjustment pattern at the point corresponding to the rotational position X=c. However, there is a problem that it is difficult to determine the point where the rotational position X=c during formation of the adjustment pattern. Therefore, in a first embodiment described next, a method is proposed by which the ejection timing of ink droplets can be adjusted such that the movement error becomes "0" at the oscillation center thereof, even when it is difficult to determine the point where the rotational position X=c.

EMBODIMENT

Description of Principle

Figure 10A:
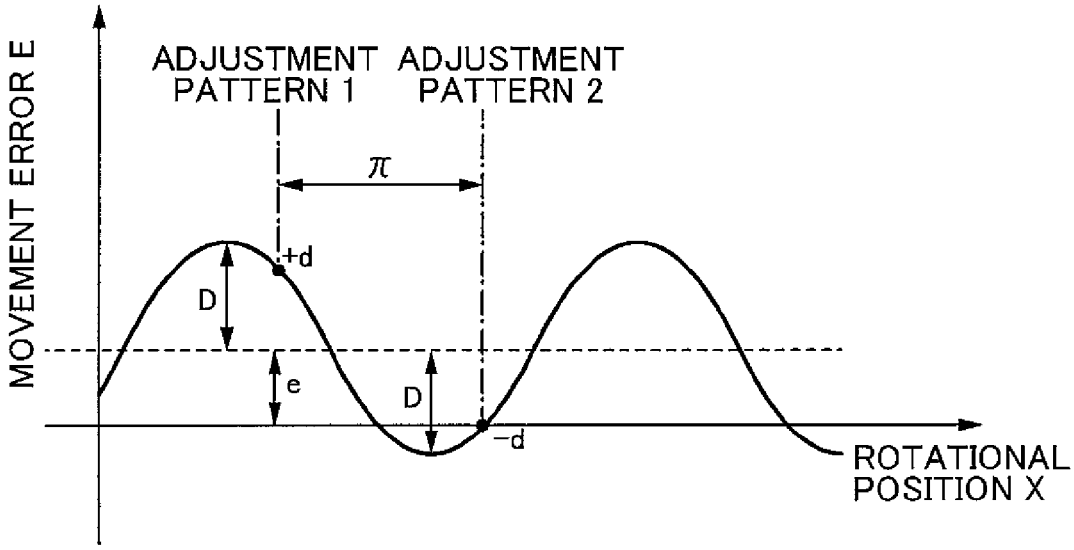
FIG. 10A is a diagram describing the relation between the rotational position of the drive pulley 34 and the movement error.

FIG. 10A is a diagram describing the relation between the rotational position of the drive pulley 34 and the movement error. The horizontal axis plots the rotational position X of the reference point P, while the vertical axis plots the movement error E at the rotational position X. In FIG. 10A, it is assumed the adjustment pattern 1 is recorded when the movement error is "+d" relative to the oscillation center "e". Then, it is assumed that the adjustment pattern 2 is recorded after the drive pulley 34 has rotated by an amount of "n" from the point where the adjustment patter 1 was recorded. The movement error E forms a sine curve. Also, the period of the movement error is the same as the circumference length of the drive pulley 34. Accordingly, the adjustment pattern 2 formed after the above rotation of the drive pulley 34 by an amount of "π" is recorded when the movement error is "−d" relative to the oscillation center "e". That is, it is possible to obtain the value of the oscillation center "e" by averaging the movement errors obtained in the adjustment patterns 1 and 2. In other words, by obtaining an average of the movement errors obtained at positions whose rotational positions are separated by a distance "π", it is possible to offset the AC components of the movement error.

Figure 10B:
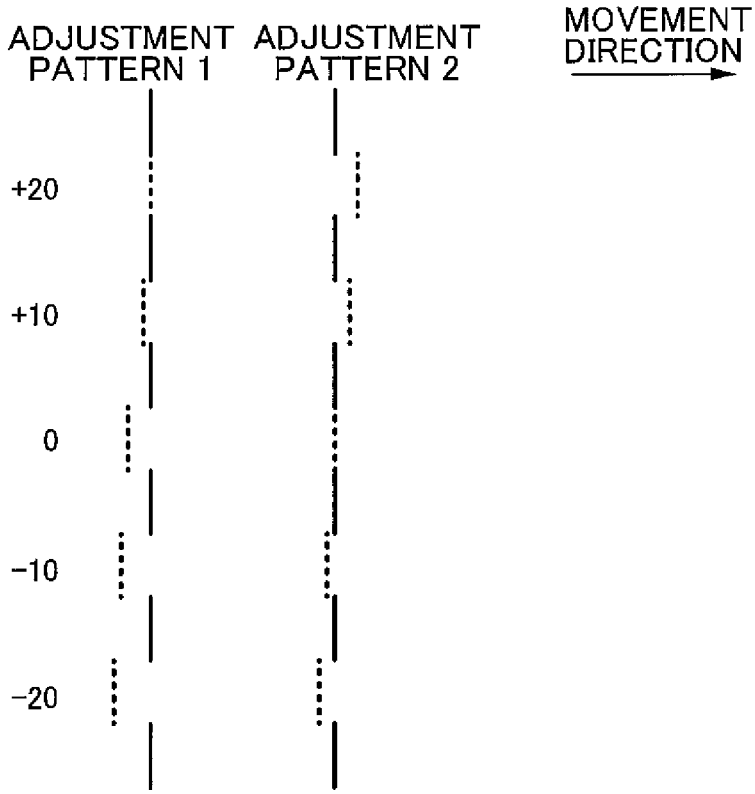
FIG. 10B is a diagram describing adjustment patterns that correspond to the patterns in FIG. 10A.

FIG. 10B is a diagram describing the adjustment patterns that correspond to the patterns in FIG. 10A. The adjustment pattern 1 is recorded when the movement error is "+d" relative to the oscillation center. The adjustment pattern 2 is recorded when the movement error is "−d" relative to the oscillation center. According to FIG. 10B, when the movement error is "+d" relative to the oscillation center, the first line and the second line formed with an adjustment amount of "+20" match. In addition, when the movement error is "−d" relative to the oscillation center, the first line and the second line formed with an adjustment amount of "0" match. In other words, because of the effect of the movement error due to decentering of the drive pulley 34, the adjustment amount with which the first line and the second line formed matched to each other differs between the adjustment pattern 1 and the adjustment pattern 2.

Figure 11:
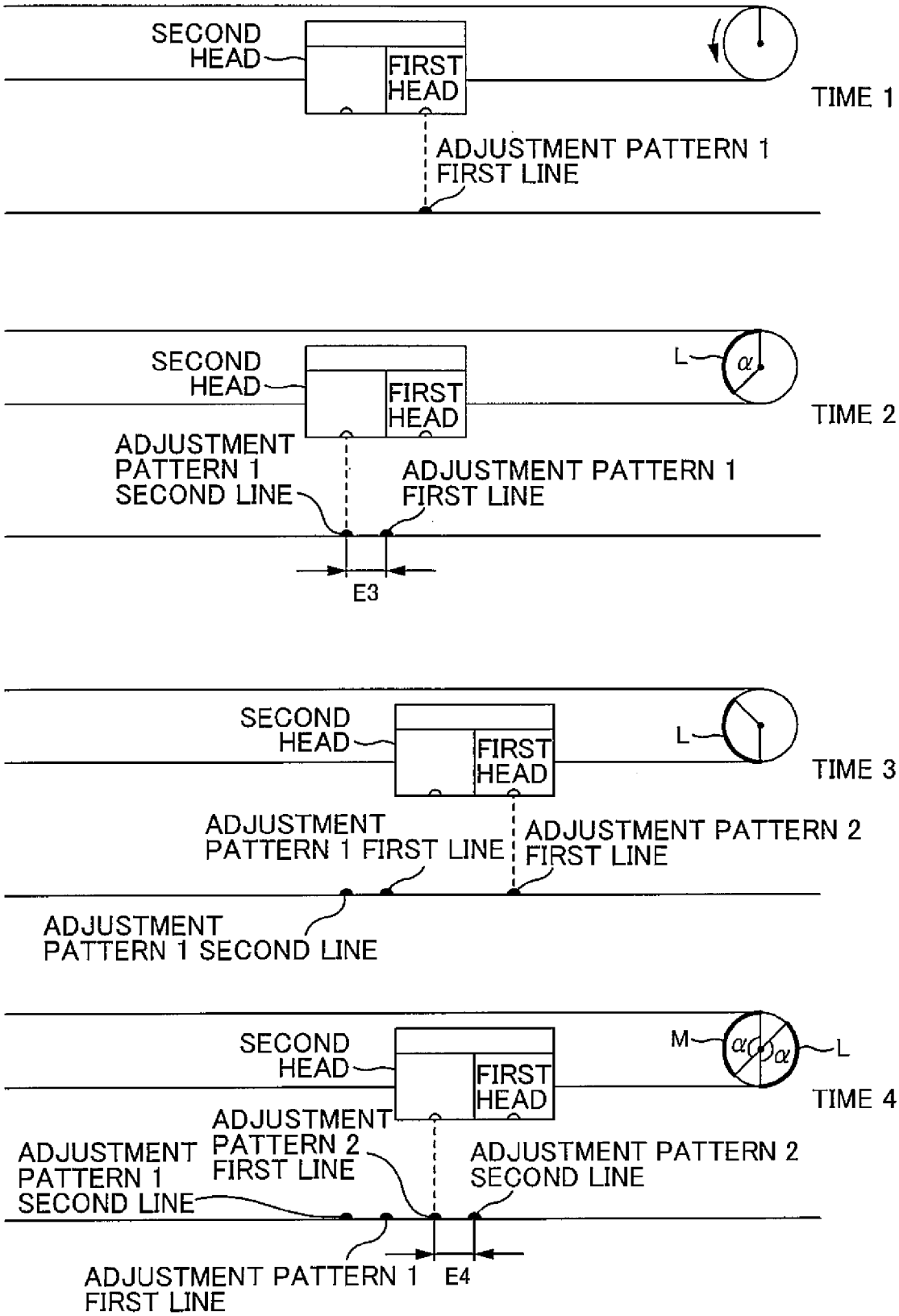
FIG. 11 is a diagram describing the movement error in an adjustment pattern 1 and an adjustment pattern 2.

FIG. 11 is a diagram describing the movement error in the adjustment pattern 1 and the adjustment pattern 2. FIG. 11 illustrates a state in which the carriage is moved in time series from a time 1 shown above to a time 4 and the adjustment pattern 1 and the adjustment pattern 2 are recorded. The time interval between the time 1 and the time 3 corresponds to a time during which the drive pulley 34 performs a half rotation. Specifically, a time required for the drive pulley 34 to rotate by an amount of "π". Further, in this case the drive pulley 34 is assumed to be decentered. In this example, the adjustment patterns are formed at rotational positions different from the rotational positions used when forming the adjustment patterns in FIGS. 10A and 10B.

At the time 1, ink droplets are ejected from the first head to record the first line of the adjustment pattern 1. Next, at the time 2, ink droplets are ejected from the second head to record the second line of the adjustment pattern 1. However, due to a movement error E3, the first line and the second line do not match with respect to the movement direction.

At the time 3, ink droplets are ejected from the first head to record the first line of the adjustment pattern 2. Next, at the time 4, ink droplets are ejected from the second head to record the second line of the adjustment pattern 2. However, due to a movement error E4, the first line and the second line do not match with respect to the movement direction.

A rotation angle γ of the drive pulley 34 for the rotation after the first line of the adjustment pattern 1 has been formed and before forming the second line of the adjustment pattern 1 starts is the same as that for the rotation after the first line of the adjustment pattern 2 has been formed before forming the second line of the adjustment pattern 2 starts. As described above, the adjustment pattern 1 and the adjustment pattern 2 are formed separated from each other by a distance corresponding to a half rotation ("π") of the drive pulley 34.

From the time 1 to the time 2, a portion L on the circumference of the drive pulley 34 passes the top of the circumference in order to move the belt and move the carriage CR. Therefore, the length of the portion of the circumference L corresponds to the movement amount during this movement. This movement amount contains the movement error E3. From the time 3 to the time 4, a portion M on the circumference of the drive pulley 34 passes the top of the circumference in order to move the belt and move the carriage CR. Therefore, the length of the circumference M corresponds to the movement amount during this movement. This movement amount contains the movement error E4.

The movement errors at the rotational positions that are shifted from each other by a distance corresponding to a half period ("π") can offset the AC components contained in the respective movement errors by averaging the same. Therefore, by averaging the movement errors, it is possible to obtain the movement error when the drive pulley 34 is not decentered. In other words, the average of the movement errors E3 and E4 represents a consistent movement error when the drive pulley 34 is not decentered.

Incidentally, when the drive pulley 34 is not decentered, the consistent movement error component can be removed by adjusting the ejection timing of ink droplets by a shift amount between the first line and the second line, so that the landing position of ink droplets from the first head and that of ink droplets from the second head can be aligned. However, even formation of the adjustment pattern is affected by the AC component of the movement error due to decentering of the drive pulley 34. Accordingly, the AC component of the movement error needs to be removed also when the ejection timing is adjusted.

With regard to this issue, as described above, the issue can be solved based on the principle that by averaging the respective movement errors at the rotational positions that are shifted from each other by an amount of "π", it is possible to obtain the movement error that offsets the AC components of the respective movement errors.

Again, FIGS. 10A and 10B are referred to. In the adjustment pattern 1, the first line and the second line match when the adjustment amount is "+20". At this time, a movement error of "+d" relative to the oscillation center "e" ("e+d" as an absolute value) is present during the formation of the adjustment pattern 1. On the other hand, in the adjustment pattern 2, the first line and the second line match when the adjustment amount is "0". At this time, a movement error of "−d" relative to the oscillation center "e" ("e−d" as an absolute value) is present during the formation of the adjustment pattern 2. Specifically, these adjustment amounts are amounts that contain the movement errors. These adjustment patterns are formed separated by a distance corresponding to a rotation for a distance "π" of the drive pulley 34. Therefore, by averaging these adjustment amounts, it is possible to offset the AC components in the movement errors contained in the adjustment amounts. That is, by averaging these adjustment amounts, it is possible to obtain the adjustment amount from which the AC component in the movement error is removed.

Specifically, the adjustment amount indicating the ejection timing judged suitable in the adjustment pattern 1 and that indicating the ejection timing judged suitable in the adjustment pattern 2 are averaged. Then, the average value thus obtained shall be the adjusted ejection timing. The adjustment amount corresponds to a consistent component "e" in the movement error described above. This obtained average value is set again in the printer 1 as the adjusted ejection timing, and thereby the ejection timing can be adjusted such that the maximum shift amount between the first line and the second line becomes the smallest.

In the adjustment pattern 1, the first line and the second line match with an adjustment amount of "+20". In the adjustment pattern 2, the first line and the second line match with an adjustment amount of "0". Accordingly, the average adjustment value is "+10". Then, by readjusting the ejection timing such that ink droplets ejected from the second head land on the further right side (assuming that the movement is from the left side to the right side) by 10 μm, appropriate ejection timing can be achieved.

Figure 12:
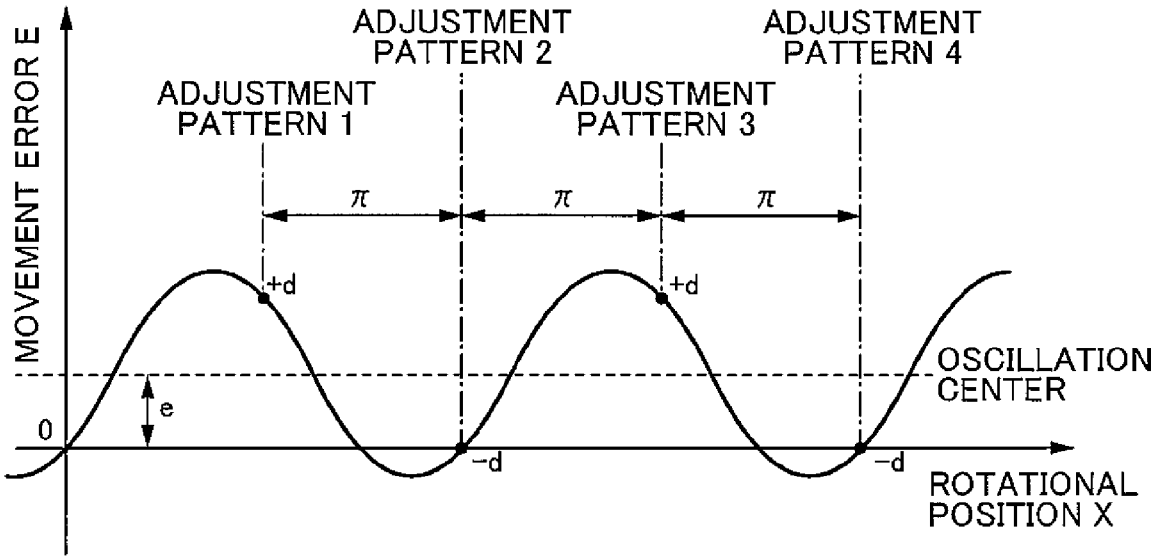
FIG. 12 is a diagram describing the case in which four adjustment patterns are used to adjust the ejection timing.

FIG. 12 is a diagram describing the case in which four adjustment patterns are used to adjust the ejection timing. The principle is the same as that described above, and it is possible by averaging adjustment amounts to obtain the adjustment amount of the ejection timing by which the movement error becomes "0" at the oscillation center thereof. In such a case, the number of samples used in obtaining the average value is large, so more precise adjustment amount of the ejection timing can be obtained.

When the adjustment pattern is not formed at every rotational angle of "π" of the drive pulley 34, by obtaining the above-described average of the adjustment amounts, it is at least possible, by obtaining the average of adjustment amounts as described above, to obtain the adjustment amount of the ejection timing by which the movement error becomes "0" at a point close to the oscillation center thereof. Therefore, even if the adjustment pattern is not formed at every rotational angle of "n" of the drive pulley 34, it is possible to obtain a favorable adjustment amount of the ejection timing.

In the embodiment, the ejection timing is adjusted by using a plurality of adjustment patterns based on the above principle.

Procedure of the Method for Adjusting Ejection Timing

Figure 13:
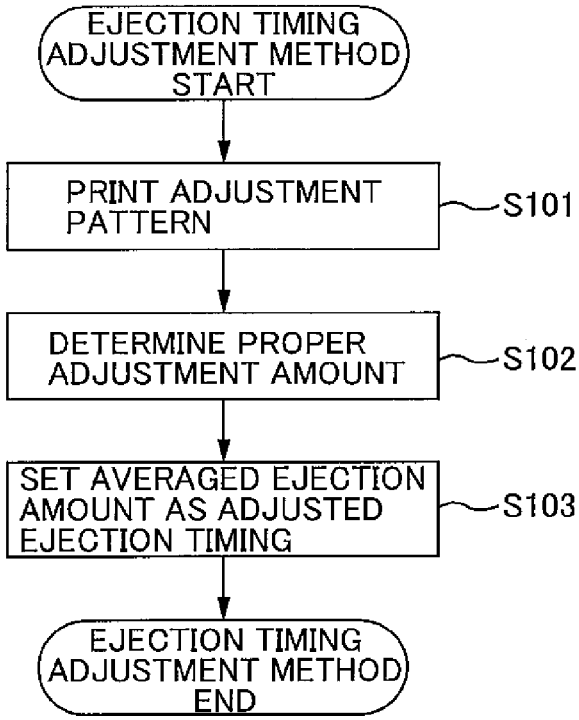
FIG. 13 is a flowchart describing a method for adjusting the ejection timing of ink droplets.

FIG. 13 is a flowchart describing a method for adjusting the ejection timing of ink droplets. Adjustment of the ejection timing of ink droplets is carried out during the manufacturing process of the printer.

Firstly, four adjustment patterns 1 to 4 are formed at every rotational angle of "π" of the drive pulley 34 on a paper (S101).

Figure 14:
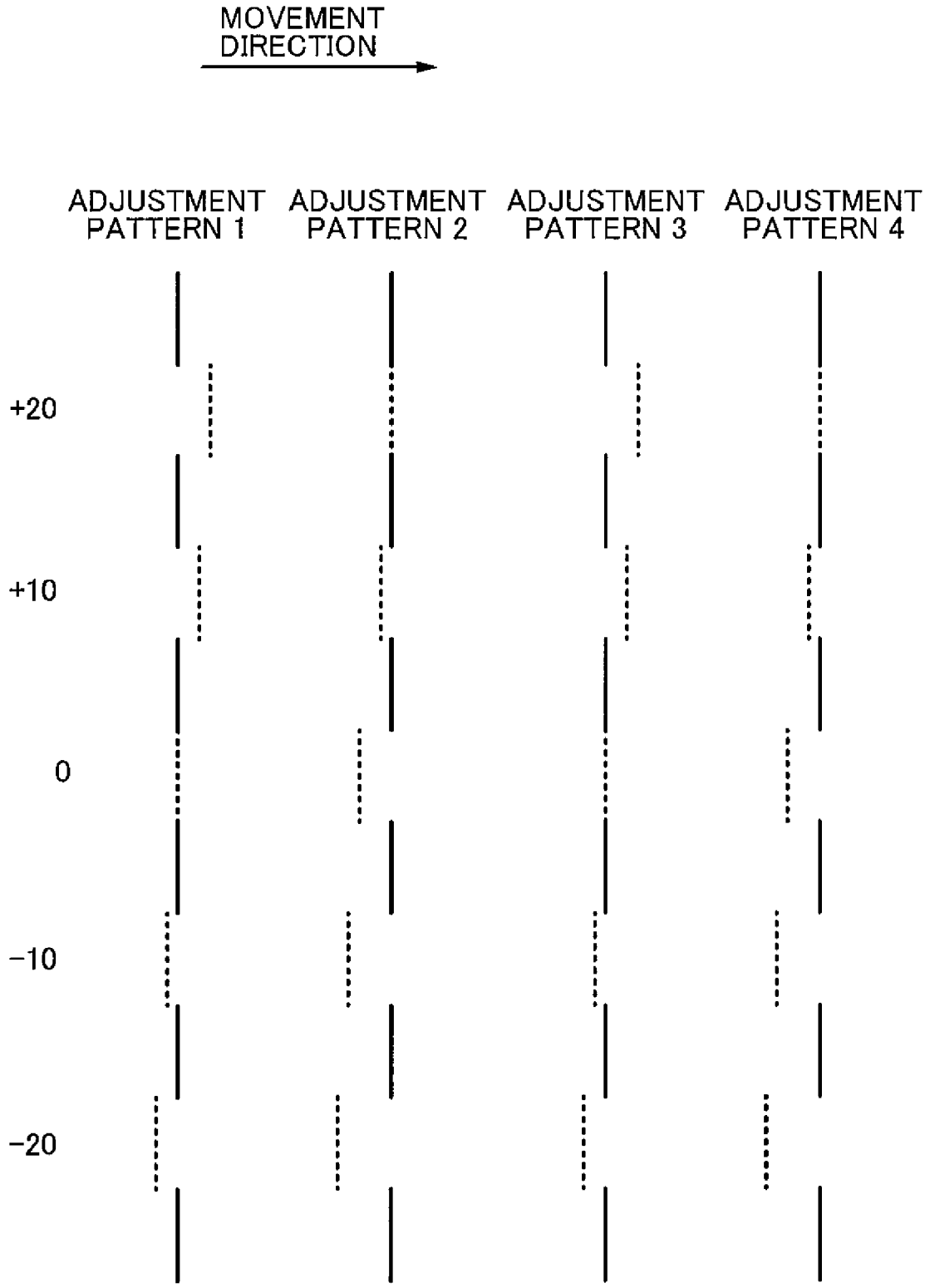
FIG. 14 is a diagram describing four adjustment patterns.

FIG. 14 is a diagram describing four adjustment patterns. FIG. 14 shows four adjustment patterns formed on the paper S with the first head 410 and the second head 420. Also in FIG. 14, the movement direction of the head while ejecting ink droplets is from the left side to the right side of the drawing. And these four adjustment patterns are sequentially referred to, from the adjustment pattern at the most left to the adjustment pattern at the most right, as an adjustment pattern 1 to an adjustment pattern 4.

After these adjustment patterns have been formed, the first line and the second line that match the most with respect to the movement direction are determined for each adjustment pattern, and the corresponding adjustment amounts are determined (S102). For example, in the adjustment pattern 1, the first line and the second line match the most with respect to the movement direction when the adjustment amount is "0". Therefore, it is determined for the first adjustment pattern 1 that the ejection timing with an adjustment amount of "0" is the best ejection timing with respect to the movement direction. In a similar manner, determination is made for the adjustment patterns 2 to 4. According to FIG. 16, the adjustment amount is determined as "+20", "0" and "+20" respectively for the adjustment patterns 2 to 4.

After the adjustment amounts of the ejection timing have been determined as above, an average value of the adjustment amounts is obtained (S103). In FIG. 14, favorable adjustment amounts of ejection timings are "0" for the adjustment pattern 1, "+20" for the adjustment pattern 2, "0" for the adjustment pattern 3, and "+20" for the adjustment pattern 4. The average value of these amounts is "+10". That is, the adjustment amount of the ejection timing that minimizes the variance in the landing positions for this printer is "+10".

Once the adjustment amount of the ejection timing is obtained, the ejection timing of ink droplets are adjusted such that the ejection timing is shifted by the amount corresponding to the obtained adjustment amount. This adjustment can be performed by changing the ejection timing by the amount corresponding to the adjustment value via a user interface of the printer 1. Also, the adjustment amount may be sent to the printer 1 via the computer 110 connected to the printer 1.

The average adjustment amount of the printer described here was "+10". Accordingly, by readjusting the ejection timing to a delayed timing such that the ink droplets ejected from the second head 420 land at the position shifted by 10 μm to the further right side in the movement direction, proper ejection timing can be achieved.

Here, although the fluctuation in the movement amount was described taking decentering of the drive pulley 34 as an example, the ejection timing can be adjusted based on the same principle also in the case in which carriage motor 31 for driving the drive pulley 34 is decentered. That is, a carriage motor 31 may be used as a rotational member to move the carriage CR.

Other Configurations of Nozzles

A case is also possible in which the user desires to perform printing at a resolution increased with respect to the paper transport direction. Next, a configuration of the head is described for performing printing at a resolution increased with respect to the paper transport direction.

Figure 15:
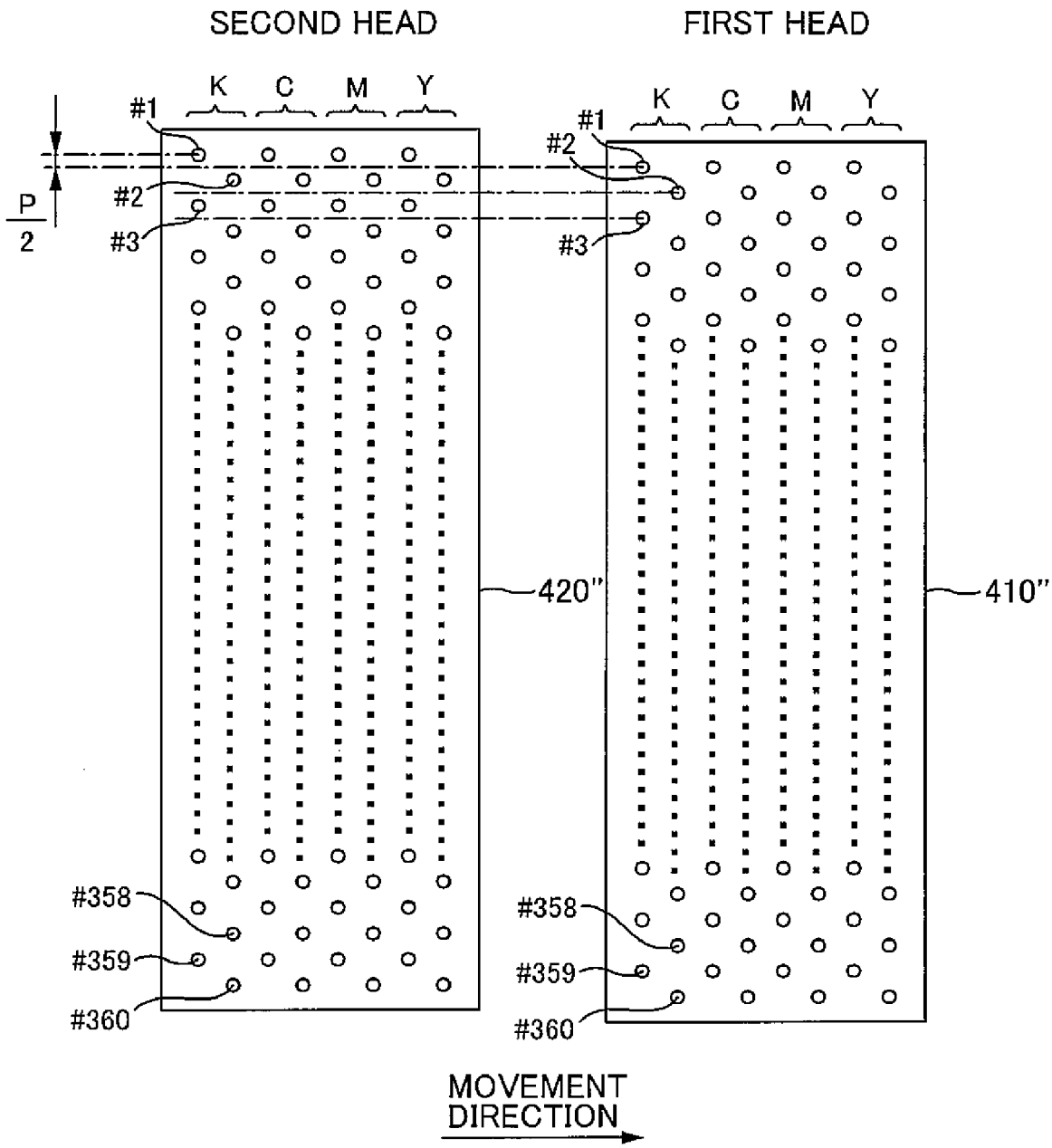
FIG. 15 is a diagram describing a variation of the configuration of the head of the first embodiment.

FIG. 15 is a diagram describing a variation of the configuration of the head. FIG. 15 shows a first head 410' and a second head 420' as a variation of the first head 410 and the second head 420. The variation provides a head configuration for performing printing at a resolution increased with respect to the transport direction.

The first head 410' includes two nozzle rows for each color, namely, eight nozzle rows in total. In this description black ink nozzles K is used as an example. The black ink nozzles K are made up of two nozzle rows, that is, an odd-numbered nozzle row and an even-numbered nozzle row. The odd-numbered nozzle row and the even-numbered nozzle row are disposed shifted from each other with respect to the movement direction. Each even-numbered nozzle is disposed so as to be placed at the center of two odd-numbered nozzles. For example, the nozzle #2 is disposed so as to be positioned between the nozzle #1 and the nozzle #3. Through this, the dot pitch that can be realized by the first head 410' alone is 360 dpi. Specifically, as shown in FIG. 15, the nozzle pitch P realized by the nozzle #1 and the nozzle #2 is 360 dpi.

The second head 420' has the same head configuration as the first head 410'. The second head 420' is disposed shifted from the first head 410' by an amount corresponding to P/2 in a transport direction. In other words, the nozzle #1 of the first head 410' is disposed so as to be positioned between the nozzle #1 and the nozzle #2 of the second head 420'. Through this, the dot pitch that can be realized by the first head 410' and the second head 420' is 720 dpi.

It should be noted that although the odd-numbered nozzle row and the even-numbered nozzle row of the first head 410' are disposed shifted from each other with respect to the direction intersecting the paper transport direction, the ejection timing of ink droplets onto the paper is adjusted such that the landing positions thereof match with respect to the carriage CR movement direction.

Through this, it is possible to perform printing at 720 dpi with respect to the paper transport direction. At such time as well, the ejection timing of ink droplets from the first head and the second head needs to be adjusted. In such a case as well, the ejection timing can be adjusted in the same manner as described above.

Other Embodiments

The above described technique can be applied to various industrial apparatuses, in addition to a printing method that involves ejecting ink onto paper or the like to perform printing. Typical examples of this include printing apparatuses (methods) for printing patterns on cloths, circuit board manufacturing apparatuses (methods) for forming circuit patterns on circuit boards, DNA chip manufacturing apparatuses (methods) for manufacturing DNA chips by applying a solution in which DNA is dissolved to a chip, and manufacturing apparatuses (methods) for displays such as organic EL displays.

The foregoing embodiment is merely for facilitating the understanding of the invention, but is not meant to be interpreted in a manner limiting the scope of the invention. The invention can of course be altered and improved without departing from the gist thereof and includes functional equivalents. In particular, the embodiments mentioned below are also included in the scope of invention.

Regarding the Heads

In the foregoing embodiment, ink was ejected using piezoelectric elements. However, the method for ejecting liquid is not limited to this. Other methods, such as a method for generating bubbles in the nozzles through heat, may also be employed.

Also, in the foregoing embodiments, the head is provided in the carriage. However, it is also possible to provide the head in an ink cartridge that can be attached and detached to and from the carriage.

CONCLUSION (1) In the foregoing embodiments, a step is carried out that involves forming adjustment patterns on the paper S by shifting relative ejection timings of ink droplets from the nozzle rows of the first head 410 and the second head 420 lined up in the direction intersecting a row direction in which nozzles of the nozzle rows of the first head 410 and the second head 420 are lined up, while shifting the nozzle row of the first head 410 (black nozzle row for example) and the nozzle row of the second head 420 (black nozzle row for example) in respect to the paper S in the direction intersecting the nozzle rows. Shifting the ejection timing of ink droplets corresponds to shifting the landing position of ink droplets.

Next, a step of determining the adjustment amounts of relative ejection timings of the first nozzle row and the second nozzle row based on the adjustment patterns is carried out.

Then, a plurality of adjustment patterns are formed separated from each other by a predetermined distance in the direction intersecting the nozzle rows. Also, the ejection timing is adjusted based on an average of the adjustment amounts determined based on the respective adjustment patterns.

Through this, the ejection timing of ink droplets ejected from a plurality of heads can be properly adjusted.

(2) The above-described predetermined distance is the circumferential length of the rotating member (such as a drive pulley) for shifting the nozzle row of the first head 410 and the nozzle row of the second head 420 when rotated a half rotation.

Through this, the most suitable ejection timing can be achieved by adjustment.

(3) The number of the adjustment patterns formed is any even number, and the ejection timing is adjusted based on the average of the adjustment amounts formed based on these adjustment patterns in an even number.

By forming the adjustment patterns in an even number, and adjusting the ejection timing based on the average of adjustment amounts in an even number in this manner, it is possible to offset the error of the landing position in the carriage movement direction included in the adjustment pattern caused by decentering of the drive pulley 34.

(4) Furthermore, with respect to the nozzle row direction of the first head 410, each nozzle of the nozzle row of the first head 410 is disposed so as to be positioned between two nozzles of the nozzle row of the second head 420.

Through this, it is possible to double the resolution in the nozzle row direction.

(5) The adjustment pattern is formed as follows; the landing position of ink droplets from the nozzle row of the second head 420 is shifted in a direction intersecting the nozzle row, with respect to the landing position of liquid droplets from the nozzle row of the first head 410, as a result of the ejection timing of ink droplets from the nozzle row of the second head 420 being shifted for each nozzle.

Through this, the landing position of ink droplets from the second head 420 is gradually shifted with respect to the landing position of ink droplets from the first head 410, so that the suitable ejection timing can be selected based on the landing position of ink droplets ejected at the shifted ejection timing.

(6) Also, the adjustment pattern is formed as follows; ink droplets ejected from a predetermined number of nozzles of the nozzle row of the first head 410 and those ejected from a predetermined number of nozzles of the nozzle row of the second head 420 land alternately with respect to the nozzle row direction of the first head 410.

Through this, ink droplets ejected from the first head and those from the second head respectively land on the paper S in a width corresponding to the predetermined number of nozzles. Therefore, the ejection timing can be determined based on the shift amount with respect to the movement direction.

(7) Furthermore, it is apparent that an ejection timing adjusting apparatus described below is possible. The ejection timing adjusting apparatus includes a recording device and an input device (such as a keyboard of the computer 110). The recording device forms adjustment patterns on the paper S by shifting relative ejection timings of ink droplets from the nozzle rows of the first head 410 and the second head 420 lined up in a direction intersecting a row direction in which nozzles of the nozzle rows of the first head 410 and the second head 420 are lined up, while shifting the nozzle rows of the first head 410 and the second head 420 in respect to the paper S in the intersecting direction of the nozzle rows of the first head 410 and the second head 420. The input device inputs the adjustment amounts of relative ejection timings of the nozzle rows of the first head 410 and those of the second head 420 based on the adjustment patterns.

A plurality of adjustment patterns are formed separated from each other by a predetermined distance in a direction intersecting the nozzle rows. Then, the ejection timing adjusting apparatus further includes an arithmetic processing section for obtaining the ejection timing based on the average of the adjustment amounts inputted based on the respective adjustment patterns.

Through this, the ejection timing of ink droplets ejected from the plurality of heads can be properly adjusted.

(8) It is apparent that a program is possible for causing a computer to execute the above methods, which thereby realizes the above-described ejection timing adjusting apparatus.

What is claimed is:

1. A method for adjusting ejection timing comprising:

forming adjustment patterns on a medium by shifting relative ejection timings of liquid droplets from a first nozzle row and a second nozzle row lined up in a direction intersecting a row direction in which nozzles of the first nozzle row and the second nozzle row are lined up, while shifting the first nozzle and the second nozzle in respect to the medium in the intersecting direction of the first nozzle row and the second nozzle row; and determining adjustment amounts of relative ejection timings of the first nozzle row and the second nozzle row based on the adjustment patterns, wherein the adjustment patterns are formed in the intersecting direction in a plural number separated from each other by a predetermined distance, and the ejection timing is adjusted based on an average of the adjustment amounts determined based on the adjustment patterns.

2. A method for adjusting ejection timing according to claim 1, wherein the predetermined distance corresponds to a circumferential length obtained when a rotating member for shifting the first nozzle row and the second nozzle row has performed a half rotation.

3. A method for adjusting ejection timing according to claim 1, wherein the adjustment patterns are formed in an even number, and the ejection timing is adjusted based on the average of the adjustment amounts formed based on the adjustment patterns in an even number.

4. A method for adjusting ejection timing according to claim 1, wherein with respect to the direction of the first nozzle row, each nozzle of the first nozzle row is positioned between two nozzles of the second nozzle row.

5. A method for adjusting ejection timing according to claim 1, wherein the adjustment patterns are formed in a manner in which the landing position of liquid droplets from the second nozzle row is shifted in the intersecting direction with respect to the landing position of liquid droplets from the first nozzle row, as a result of the ejection timing of liquid droplets from the second nozzle row being shifted for each nozzle.

6. A method for adjusting ejection timing according to claim 1, wherein the adjustment patterns are formed in a manner in which ink droplets ejected from a predetermined number of nozzles of the first nozzle row and ink droplets ejected from a predetermined number of nozzles of the second nozzle row alternately land with respect to the first nozzle row direction.

7. An ejection timing adjusting apparatus, comprising:

a recording device that forms adjustment patterns on a medium by shifting relative ejection timings of liquid droplets from a first nozzle row and a second nozzle row lined up in an intersecting direction in which nozzles of the first nozzle row and the second nozzle row are lined up, while shifting the first nozzle row and the second nozzle row in respect to the medium in the intersecting direction of the first nozzle row and the second nozzle row; and an input device that inputs adjustment amounts of relative ejection timings of the first nozzle row and the second nozzle row based on the adjustment patterns, wherein the adjustment patterns are formed in the intersecting direction in a plural number separated from each other by a predetermined distance, and the apparatus further includes an arithmetic processing section that obtains the ejection timing based on an average of the adjustment amounts inputted based on the adjustment patterns.

* * * * *